US011344061B2

(12) United States Patent
Rodriguez et al.

(10) Patent No.: US 11,344,061 B2
(45) Date of Patent: May 31, 2022

(54) SELF-LOCKING CIGAR CUTTING TOOL

(71) Applicants: Luis J. Rodriguez, Southington, CT (US); Kyle Saucier, Killingworth, CT (US)

(72) Inventors: Luis J. Rodriguez, Southington, CT (US); Kyle Saucier, Killingworth, CT (US)

( * ) Notice: Subject to any disclaimer, the term of this patent is extended or adjusted under 35 U.S.C. 154(b) by 0 days.

(21) Appl. No.: 17/179,393

(22) Filed: Feb. 18, 2021

(65) Prior Publication Data

US 2021/0251284 A1 Aug. 19, 2021

Related U.S. Application Data

(60) Provisional application No. 62/978,177, filed on Feb. 18, 2020.

(51) Int. Cl.
*A24F 13/26* (2006.01)

(52) U.S. Cl.
CPC ..... *A24F 13/26* (2013.01)

(58) Field of Classification Search
CPC ..... A24F 13/26; A24F 13/24; A24F 13/00; B25F 1/04; A44B 15/00
USPC ..... 30/111–121, 155–161, 229, 253, 28, 29, 30/279.2, 248; D27/195
See application file for complete search history.

(56) References Cited

U.S. PATENT DOCUMENTS 1,096,219 A * 5/1914 Bippart ..... A24F 13/26 30/112
1,124,288 A * 1/1915 Bulman ..... A24F 13/26 7/165
1,454,994 A * 5/1923 De Matteo ..... A24F 13/26 30/146
1,757,607 A * 5/1930 Zullo ..... A24F 13/24 131/249
5,937,523 A 8/1999 Van Keppel et al.
9,119,422 B2 9/2015 Lance et al.
(Continued)

FOREIGN PATENT DOCUMENTS

FR 2821580 A1 * 9/2002 ..... A24F 13/26
GB 191010462 A * 9/1910 ..... A24F 13/26

OTHER PUBLICATIONS

Benchmade 1500-191 Cigar Cutter, https://pacificflywaysupplies.com/products/benchmade-1500-191-cigar-cutter?variant-31799947788399.

(Continued)

*Primary Examiner* — Ghassem Alie

(57) ABSTRACT

A self-locking cigar cutting tool aids in the effective preparation of a cigar for consumption by creating a clean-cut mouthpiece. The self-locking cigar cutting tool is provided with a first retainer plate and a second retainer plate, wherein a cutting arm is pivotably mounted therein. An annular cutting aperture is formed into the first retainer plate and the second retainer plate, wherein the fixed blade is engaged into the annular cutting aperture opposite the cutting arm. The arcuate channel is formed into the cutting arm such that the detent element may operably engage between the cutting arm, and the first retainer plate and the second retainer plate. The detent element may be biased into a locked configuration, wherein the cutting arm will be captured in a closed configuration. The cutting arm may be biased into an open position, causing the cutting arm to extend when released from the detent element.

19 Claims, 4 Drawing Sheets

(56) References Cited

U.S. PATENT DOCUMENTS

| | | | | |
|---|---|---|---|---|
| 10,820,628 | B2 | 11/2020 | France | |
| 11,083,218 | B1 * | 8/2021 | Mandeville | A24F 13/26 |
| 2007/0089299 | A1 * | 4/2007 | Belaubre | A24F 13/26 30/112 |
| 2010/0257741 | A1 | 10/2010 | Lin | |
| 2015/0000140 | A1 * | 1/2015 | Lance | A24F 13/26 30/112 |
| 2019/0380384 | A1 * | 12/2019 | France | A24F 13/26 |

OTHER PUBLICATIONS

Xikar 3D Mayan Stainless Steel Cigar Cutter, https://www.elighters.com/xi302my3d.html.

* cited by examiner

SELF-LOCKING CIGAR CUTTING TOOL

The current application claims a priority to the U.S. provisional patent application Ser. No. 62/978,177 filed on Feb. 18, 2020.

FIELD OF THE INVENTION

The present invention generally relates to tools and devices enabling the preparation of cigars or similar items for consumption. More specifically, the present invention relates to a device for cutting the ends from cigars to create a mouthpiece.

BACKGROUND OF THE INVENTION

A portable cutting device for cigars with a simple, easy-to-handle design is in demand. A cigar is a cylindrical roll of tobacco that has been cured for smoking. They are of various lengths and thicknesses and usually have an outer wrapping made of a tobacco leaf. Cigar smokers typically use a knife to cut cigars across the longitudinal axis of the cigar so that they can be properly smoked.

Most cigars, including those that are handmade, have a cap (a small, round piece of wrapper leaf attached to the head of the cigar), and a portion of this cap must be removed to smoke the cigar. Usually, this cap can be cut with a knife or cigar cutter.

Currently, many cigar cutters are available to mechanically cut off one or both ends of a cigar. Most cigar cutters have at least one blade; however, these cigar cutters often have a bulky design that makes them inconvenient for providing a proper cut.

Cutting the cap inappropriately, jaggedly, or carelessly may cause problems with the 'smokeability' of the cigar. For example, the end of the cigar may not burn evenly, or the outer layer of the cigar may unravel from the cut end. Depending on the sharpness or alignment of their blades, cutters may be unable to render a clean and well-defined cut that does not damage the constitution of the cigar. For example, a cutter can crush the cigar, loosening the compacted filler adjacent to the cut. Such loosened filler can alter the flow characteristics of the cigar and can fall from the head through the opening as the cigar is being smoked, sending undesirable flakes of filler into the smoker's mouth. Thus, there is a need to develop a device to solve these problems.

The present invention is intended to address problems associated with and/or otherwise improve on conventional devices through an innovative cigar-cutting device that is designed to provide a convenient means of portability while incorporating other problem-solving features.

DETAIL DESCRIPTIONS OF THE INVENTION

Figure 1:
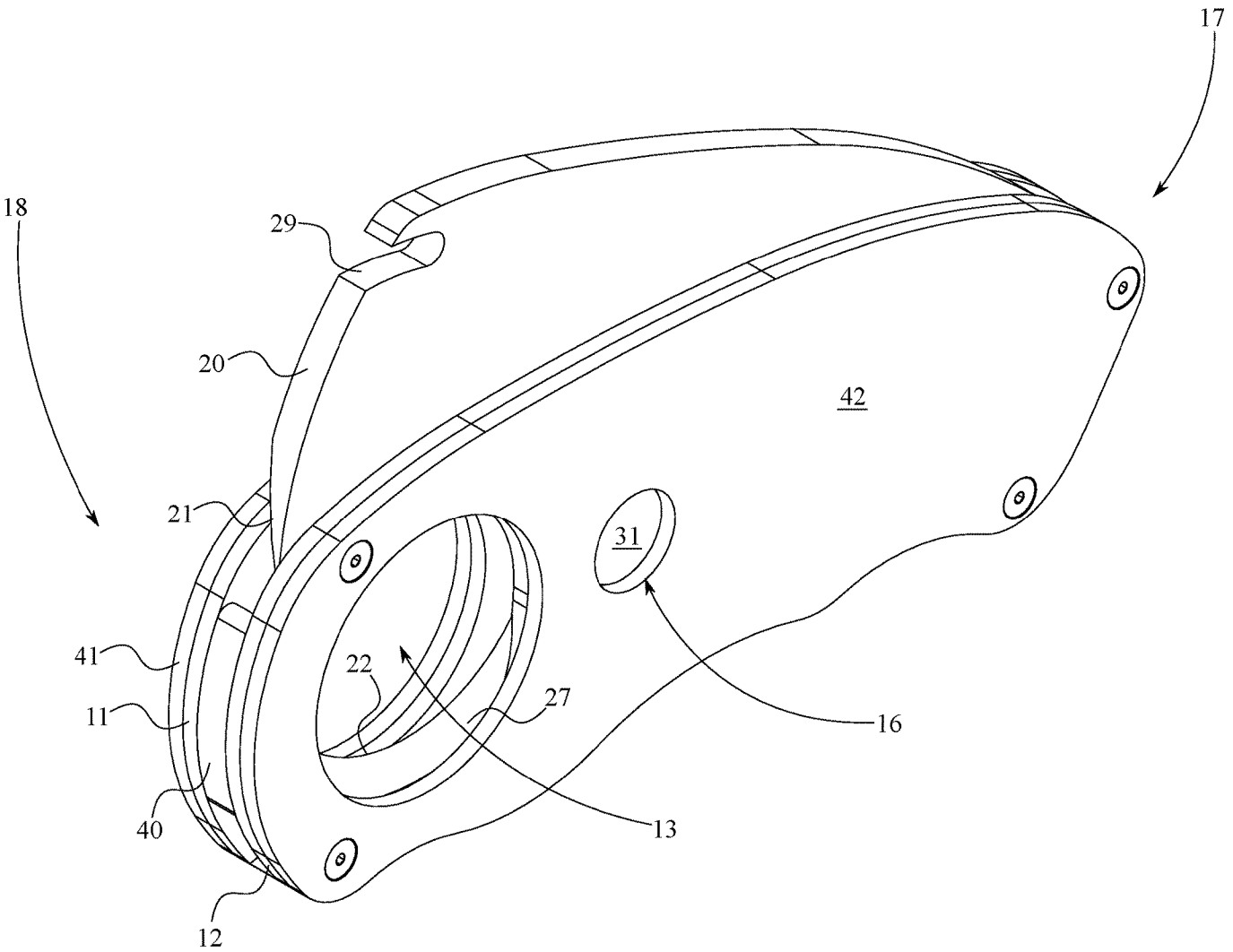
FIG. 1 is a top-front-left perspective view of one embodiment of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

As shown in FIG. 1 through 4, the present invention is a self-locking cigar cutting tool. The present invention comprises a first retainer plate 11, a second retainer plate 12, a cutting arm 20, an annular cutting aperture 13, a fixed blade 27, an arcuate channel 23, and a detent element 31. The first retainer plate 11 defines an elongated structural element arranged opposite to the second retainer plate 12, such that the internal mechanism of the present invention is encased within a protective envelope delineated by the first retainer plate 11 and the second retainer plate 12. The cutting arm 20 defines a mobile blade-bearing structure configured to operably sever the end of a cigar, or other similar item. The first retainer plate 11, the second retainer plate 12, and the cutting arm 20 each extend between a pivot end 17 and a cutting end 18, wherein the pivot end 17 defines a position about which the cutting arm 20 may angularly deflect from the first retainer plate 11 and the second retainer plate 12. Accordingly, the first retainer plate 11 is positioned offset from the second retainer plate 12 and the cutting arm 20 is pivotally mounted between the first retainer plate 11 and the second retainer plate 12 adjacent to the pivot end 17. The cutting end 18 broadly defines the operating end of the present invention, wherein the cutting arm 20 intersects and severs the end of a cigar. More specifically, the annular cutting aperture 13 traverses through the first retainer plate 11 and the second retainer plate 12 between the cutting end 18 and the pivot end 17 such that the cutting arm 20 substantially occludes the cutting aperture when in a closed configuration. Further, the fixed blade 27 is integrated into the annular cutting aperture 13 to ensure that any length of a cigar that is inserted into the annular cutting aperture 13 is fully severed with a single closing stroke of the cutting arm 20.

Figure 3:
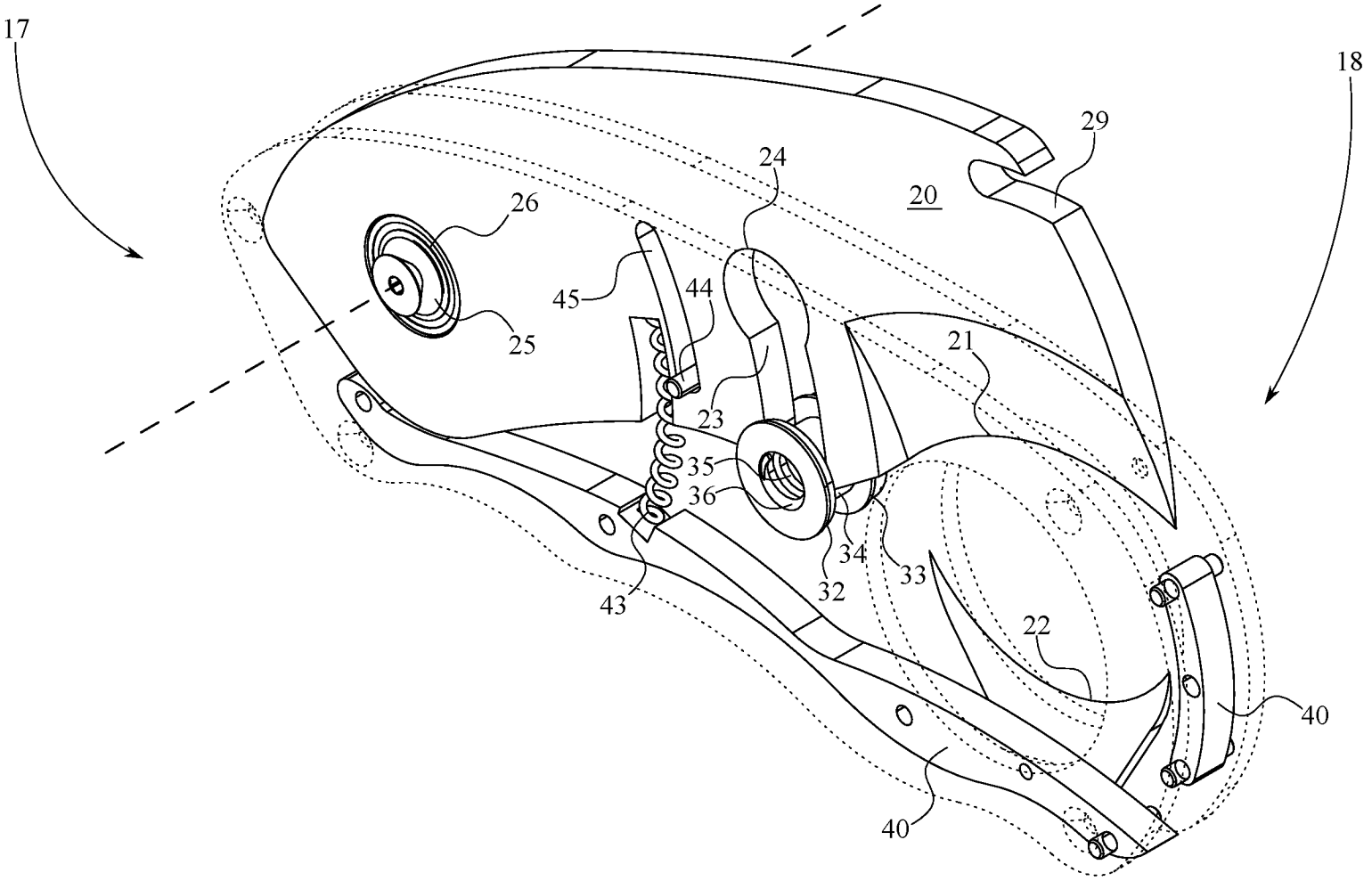
FIG. 3 is a top-front-right perspective view thereof; wherein portions of the present invention are shown as transparent to illustrate mechanical construction, and the mechanism is in an 'open' configuration.
Figure 4:
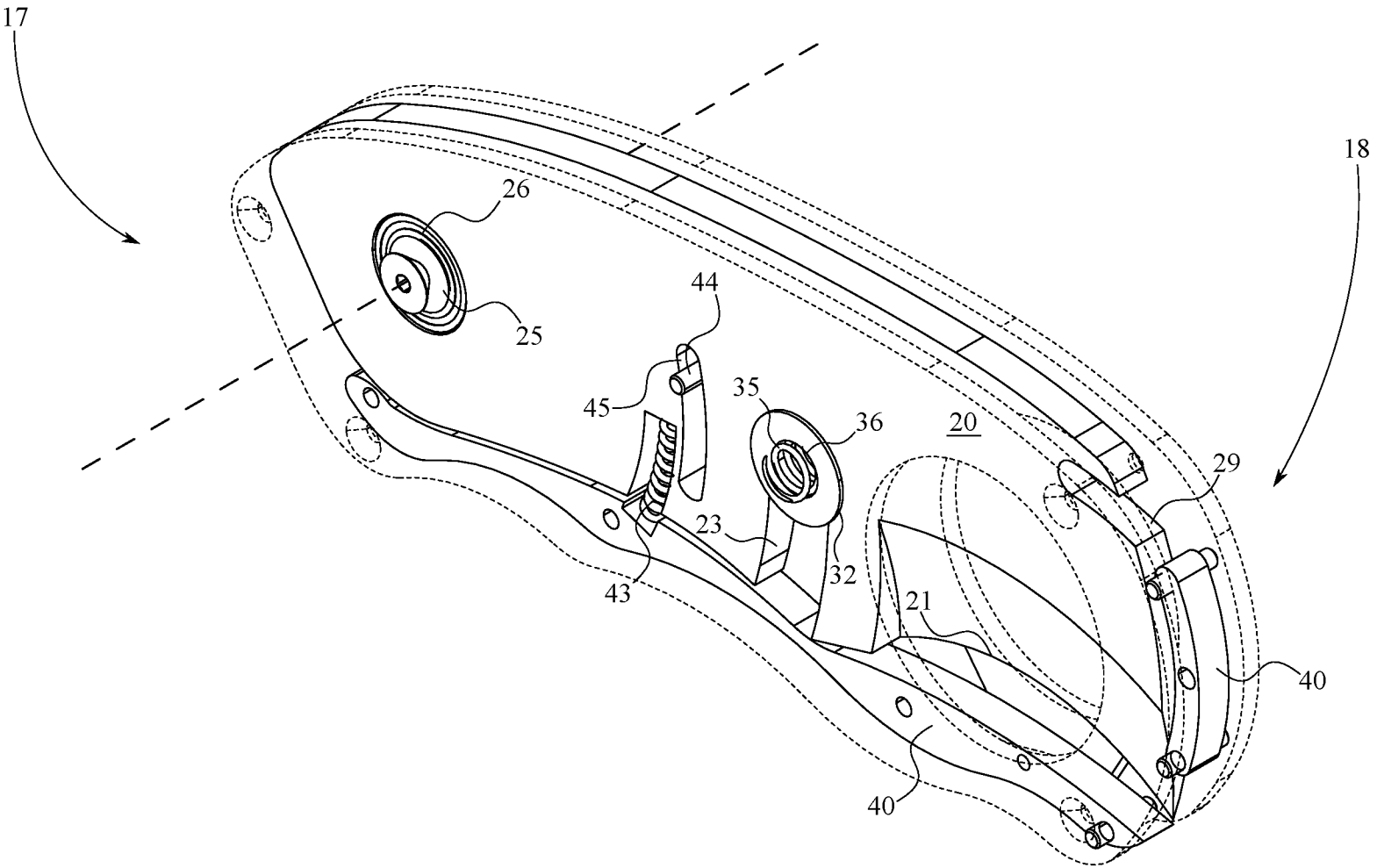
FIG. 4 is a top-front-right perspective view thereof; wherein portions of the present invention are shown as transparent to illustrate mechanical construction, and the mechanism is in a 'closed' configuration.

In reference to FIGS. 3 and 4, the present invention additionally features a novel locking mechanism enabled by the articulation of the detent element 31. More specifically, a first locking perforation 14 traverses through the first retainer plate 11, a second locking perforation 15 traverses through the second retainer plate 12, and an intermediary locking perforation 24 traverses through the cutting arm 20. When the cutting arm 20 is in the closed configuration, a locking conduit 16 is formed through the concentric alignment of the first locking perforation 14, the intermediary locking perforation 24, and the second locking perforation 15 as shown in FIG. 4. The detent element 31 operably engages into the locking conduit 16 to mechanically fix the cutting arm 20 into a closed configuration between the first retainer plate 11 and the second retainer plate 12, allowing the present invention to be stored and transported in a compact form without exposing any sharp edges. To move the cutting arm 20 to an open configuration, the detent element 31 is disengaged from the locking conduit 16. The arcuate channel 23 is formed into the cutting arm 20, traversing across the cutting arm 20 and intersecting with the intermediary locking perforation 24, whereby the detent element 31 may translate from engagement within the locking conduit 16 into the arcuate channel 23. In summation, the detent element 31 is movably positioned within the arcuate channel 23 and removably engaged with the locking conduit 16, wherein the cutting arm 20 is locked into a closed position through the removeable engagement of the detent element 31 within the locking conduit 16.

The detent element 31 further defines a series of mechanical engagement features distributed along the lengthwise extent of this component, enabling operable engagement and disengagement within the locking conduit 16 and the arcuate channel 23. Accordingly, the detent element 31 comprises a first locking ring 32, an intermediary shaft 34, and a second locking ring 33, the intermediary shaft 34 being terminally connected between the first locking ring 32 and the second locking ring 33. The first locking ring 32 and the second locking ring 33 are larger in diameter than the intermediary shaft 34, enabling the detent element 31 to impede the rotation of the cutting arm 20 when the first locking ring 32 is engaged into the second locking perforation 15 and the first locking ring 32 is engaged into the intermediary locking perforation 24 as shown in FIG. 4. As shown in FIG. 3, the cutting arm 20 may be released when the first locking ring 32 is engaged into the first locking perforation 14 and the intermediary shaft 34 is aligned within the arcuate channel 23. To wit, the intermediary shaft 34 is movably positioned along the arcuate channel 23, and the first locking ring 32 and the second locking ring 33 removably engage with the locking conduit 16. In practice, the detent element 31 will be actuated within the locking conduit 16 to bring the intermediary shaft 34 into the arcuate channel 23. The cutting arm 20 will then pivot away from the first retainer plate 11 and the second retainer plate 12, clearing the annular cutting aperture 13. This outward pivot will cause the intermediary shaft 34 to traverse the arcuate channel 23, wherein the detent element 31 does not obstruct the motion of the cutting arm 20. The cutting arm 20 may then reverse to pivot inward, toward the first retainer plate 11 and the second retainer plate 12. This motion will draw the cutting arm 20 across the annular cutting aperture 13, severing any item therein. The detent element 31 may then reengage into the locking conduit 16, fixing the cutting arm 20 in place.

Figure 2:
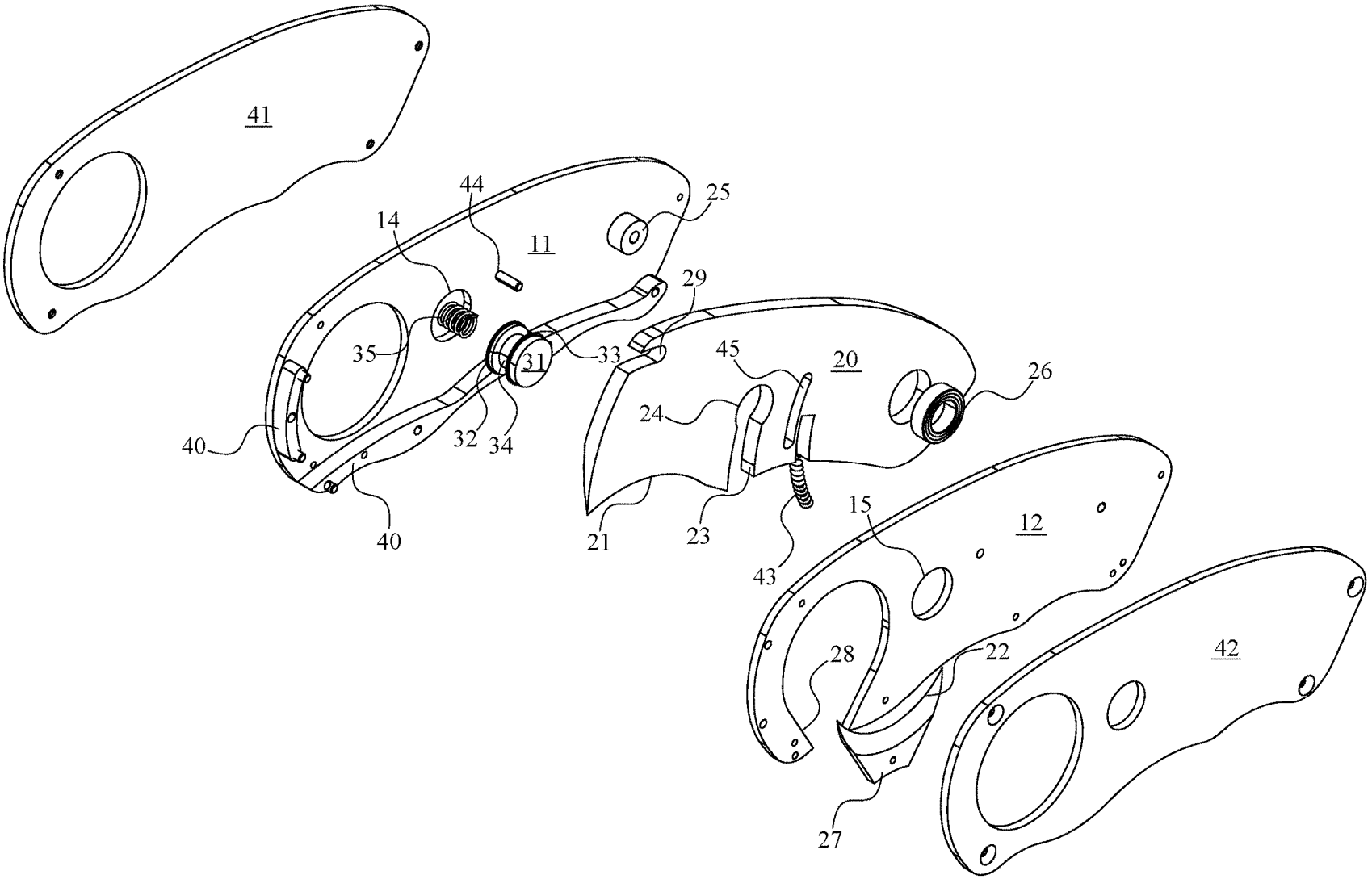
FIG. 2 is an exploded perspective view thereof.

In at least one alternate embodiment, the first retainer plate 11 further comprises an axle 25 and the cutting arm 20 further comprises a bearing element 26 as shown in in FIG. 2. The axle 25 extends between the first retainer plate 11 and the second retainer plate 12, defining a fixed position about which the cutting arm 20 may pivot. Accordingly, the bearing element 26 is integrated into the cutting arm 20 adjacent to the pivot end 17. In the ideal embodiment, the bearing element 26 defines a sealed-track rotary ball-bearing, though this embodiment is not intended to preclude the use of any other type or variety of bearing as may be realized by an individual with ordinary skill in the art. The axle 25 is rotatably engaged with the bearing element 26 to provide a smooth articulation of the cutting arm 20, preventing binding or deflection of the cutting arm 20 relative to the annular cutting aperture 13.

It is further considered the translation of the detent element 31 may be triggered automatically to trigger a 'lock-on-close' function, preventing the cutting arm 20 from opening without an intentional actuation of the detent element 31. Accordingly, the detent element 31 further comprises a detent spring 35 and a spring-receiving cavity 36. The spring-receiving cavity 36 traverses into the second locking ring 33, providing a retention area and guide for the detent spring 35. The detent spring 35 is positioned between the spring-receiving cavity 36 and the first retainer plate 11, wherein the detent spring 35 displaces the detent element 31 into the locking conduit 16. As outlined previously, the locking conduit 16 is only unobstructed when the cutting arm 20 has reached a fully closed position as shown in FIG. 4. Consequently, the detent element 31 cannot engage into the locking conduit 16 under force from the detent spring 35 until the cutting stroke is complete. At this point, the detent element 31 engages into the locking conduit 16 automatically to fix the cutting arm 20 in place.

Further, it is proposed that the cutting arm 20 may be biased towards an open configuration to enable immediate use upon the articulation of the detent element 31. To enable this functionality, a spine 40 is connected in between the first retainer plate 11 and the second retainer plate 12. The spine 40 extends between the pivot end 17 and the cutting end 18 of the first retainer plate 11 and the second retainer plate 12, providing structural support to the present invention and establishing a spring perch adjacent to the cutting arm 20. Accordingly, a mainspring 43 is mounted between the cutting arm 20 and the spine 40, wherein the mainspring 43 displaces the cutting arm 20 away from the spine 40. The mainspring 43 is shown in exemplary as a coil spring at full extension and compression in FIGS. 3 and 4, respectively. However, it is proposed that the mainspring 43 may define a flat or leaf-type spring in various alternate embodiments without departing from the original spirit and scope of the present invention.

In an alternate embodiment, the present invention may provide a means of limiting the range of motion of the cutting arm 20 relative to the first retainer plate 11 and the second retainer 12 plate. Accordingly, the first retainer plate 11 further comprises a travel pin 44 and the cutting arm 20 further comprises a travel slot 45. The travel pin 44 extends between the first retainer plate 11 and the second retainer plate 12. The travel slot 45 traverses through the cutting arm 20 along a coradial path to the arcuate channel 23, thereby enabling the travel pin 44 to traverse within the travel slot 45 as the cutting arm 20 articulates. More specifically, the travel pin 44 is freely positioned within the travel slot 45, wherein the articulation of the cutting arm 20 is arrested by the impingement of the travel pin 44 upon the terminal ends of the travel slot 45.

The effective severance of a cigar tip, cleanly separating the wrapped layers of tobacco leaf in a single stroke, is critical to properly preparing a cigar. To this end, the present invention may feature a particular blade geometry that creates a fine shear plane suitable for this purpose as shown in FIGS. 3 and 4. Specifically, the cutting arm 20 comprises a first concave blade 21, the fixed blade 27 comprises a second concave blade 22, and the first concave blade 21 is positioned laterally opposite the second concave blade 22 within the annular cutting aperture 13. The arrangement of two steep-grind concave cutting surfaces with minimal lateral offset creates an exceptionally fine cutting plane, wherein the tobacco leaf is shorn cleanly between the first concave blade 21 and the second concave blade 22 as the cutting arm 20 traverses the annular cutting aperture 13.

A means of exchanging the bladed elements described above would extend the operating lifetime of the of the present invention by allowing a user to replace the most immediately fragile wear-items. In at least one alternate embodiment, the second retainer plate 12 comprises a blade receptacle 28. As shown in FIG. 2, the blade receptacle 28 traverses through the second retainer plate 12 adjacent to the annular cutting aperture 13, wherein the fixed blade 27 removably engages into the blade receptacle 28. Attachment of the fixed blade 27 may be achieved through any known fastening means without departing from the original spirit and scope of the present invention.

An additional alternate embodiment may feature a means of opening a bottle cap utilizing the cutting arm 20. The cutting arm 20 comprises a cap notch 29, wherein the cap notch 29 traverses into the cutting arm 20 adjacent to the cutting end 18. The cap notch 29 is positioned adjacent to the first retainer plate 11 and the second retainer plate 12 when the cutting arm 20 is in a closed configuration, enabling the first retainer plate 11 and the second retainer plate 12 to act as cam surfaces against a bottle. In some embodiments the cap notch 29 is positioned opposite the first concave blade 21 on the cutting arm 20. Furthermore, in some embodiments, the cap notch 29 is positioned adjacent to the cutting end 18 of the cutting arm 20, though the position of the cap notch 29 may vary in different embodiments. This arrangement increases the mechanical advantage against the bottle cap by improving the effective torsional force applied via the cap notch 29.

The present invention may further comprise a first external scale 41 and a second external scale 42. The first external scale 41 and the second external scale 42 constitute protective panels mounted to the outer facets of the present invention, both for protective and aesthetic purposes. Specifically, the first external scale 41 is mounted to the first retainer plate 11 opposite the second retainer plate 12 and the second external scale 42 is mounted to the second retainer plate 12 opposite the first retainer plate 11.

Although the invention has been explained in relation to its preferred embodiment, it is to be understood that many other possible modifications and variations can be made without departing from the spirit and scope of the invention as hereinafter claimed.

What is claimed is:

1. A self-locking cigar cutting tool comprising:
a first retainer plate;
a second retainer plate;
a cutting arm;
an annular cutting aperture;
a fixed blade;
an arcuate channel;
a detent element;
the first retainer plate, the second retainer plate, and the cutting arm each extending between a pivot end and a cutting end;
the first retainer plate being positioned offset from the second retainer plate;
the cutting arm being pivotally mounted between the first retainer plate and the second retainer plate adjacent to the pivot end;
the annular cutting aperture traversing through the first retainer plate and the second retainer plate between the cutting end and the pivot end;
the fixed blade being integrated into the annular cutting aperture;
a first locking perforation traversing through the first retainer plate;
a second locking perforation traversing through the second retainer plate;
an intermediary locking perforation traversing through the cutting arm;
a locking conduit being formed through the concentric alignment of the first locking perforation, the intermediary locking perforation, and the second locking perforation, wherein the locking conduit is oriented laterally;
the arcuate channel being formed into the cutting arm, traversing across the cutting arm and intersecting with the intermediary locking perforation; and
the detent element being movably positioned within the arcuate channel and removably engaged with the locking conduit, wherein the cutting arm is locked into a closed position through the removeable engagement of the detent element within the locking conduit.

2. The self-locking cigar cutting tool as claimed in claim 1 comprising:
the detent element comprising a first locking ring, an intermediary shaft, and a second locking ring;
the intermediary shaft being terminally connected between the first locking ring and the second locking ring; and
the first locking ring and the second locking ring being larger in diameter than the intermediary shaft, wherein the intermediary shaft is movably positioned along the arcuate channel, and wherein the first locking ring and the second locking ring removably engage with the locking conduit.

3. The self-locking cigar cutting tool as claimed in claim 1 comprising:
the first retainer plate further comprising an axle;
the cutting arm further comprising a bearing element;
the axle extending between the first retainer plate and the second retainer plate;
the bearing element being integrated into the cutting arm adjacent to the pivot end; and
the axle being rotatably engaged with the bearing element.

4. The self-locking cigar cutting tool as claimed in claim 1 comprising:
the detent element further comprising a detent spring and a spring-receiving cavity;
the spring-receiving cavity traversing into the second locking ring; and
the detent spring being engaged between the spring-receiving cavity and the first retainer plate, wherein the detent spring displaces the detent element into the locking conduit.

5. The self-locking cigar cutting tool as claimed in claim 1 comprising:
a spine being connected in between the first retainer plate and the second retainer plate;
the spine extending between the pivot end and the cutting end; and
a mainspring being mounted between the cutting arm and the spine, wherein the mainspring displaces the cutting arm away from the spine.

6. The self-locking cigar cutting tool as claimed in claim 1 comprising:
the first retainer plate further comprising a travel pin;
the cutting arm further comprising a travel slot;
the travel pin extending between the first retainer plate and the second retainer plate;
the travel slot traversing through the cutting arm along a coradial path to the arcuate channel; and
the travel pin being freely positioned within the travel slot, wherein the articulation of the cutting arm is arrested by the impingement of the travel pin upon the terminal ends of the travel slot.

7. The self-locking cigar cutting tool as claimed in claim 1 comprising:

the cutting arm comprising a first concave blade;

the fixed blade comprising a second concave blade; and the first concave blade being positioned laterally opposite the second concave blade within the annular cutting aperture.

8. The self-locking cigar cutting tool as claimed in claim 1 comprising:

the second retainer plate comprising a blade receptacle;

the blade receptacle traversing through the second retainer plate adjacent to the annular cutting aperture; and the fixed blade removably engaging into the blade receptacle.

9. The self-locking cigar cutting tool as claimed in claim 1 comprising:

the cutting arm comprising a cap notch; and the cap notch traversing into the cutting arm adjacent to the cutting end, wherein the cap notch is positioned adjacent to the first retainer plate and the second retainer plate when the cutting arm is in a closed configuration.

10. The self-locking cigar cutting tool as claimed in claim 1 comprising:

a first external scale;

a second external scale;

the first external scale being mounted to the first retainer plate opposite the second retainer plate; and the second external scale being mounted to the second retainer plate opposite the first retainer plate.

11. A self-locking cigar cutting tool comprising:

a first retainer plate;

a second retainer plate;

a cutting arm;

an annular cutting aperture;

a fixed blade;

an arcuate channel;

a detent element;

the first retainer plate, the second retainer plate, and the cutting arm each extending between a pivot end and a cutting end;

the first retainer plate being positioned offset from the second retainer plate;

the cutting arm being pivotally mounted between the first retainer plate and the second retainer plate adjacent to the pivot end;

the annular cutting aperture traversing through the first retainer plate and the second retainer plate between the cutting end and the pivot end;

the fixed blade being integrated into the annular cutting aperture;

a first locking perforation traversing through the first retainer plate;

a second locking perforation traversing through the second retainer plate;

an intermediary locking perforation traversing through the cutting arm;

a locking conduit being formed through the concentric alignment of the first locking perforation, the intermediary locking perforation, and the second locking perforation, wherein the locking conduit is oriented laterally;

the arcuate channel being formed into the cutting arm, traversing across the cutting arm and intersecting with the intermediary locking perforation;

the detent element being movably positioned within the arcuate channel and removably engaged with the locking conduit, wherein the cutting arm is locked into a closed position through the removeable engagement of the detent element within the locking conduit;

the detent element comprising a first locking ring, an intermediary shaft, and a second locking ring;

the intermediary shaft being terminally connected between the first locking ring and the second locking ring; and the first locking ring and the second locking ring being larger in diameter than the intermediary shaft, wherein the intermediary shaft is movably positioned along the arcuate channel, and wherein the first locking ring and the second locking ring removably engage with the locking conduit.

12. The self-locking cigar cutting tool as claimed in claim 11 comprising:

the first retainer plate further comprising an axle;

the cutting arm further comprising a bearing element;

the axle extending between the first retainer plate and the second retainer plate;

the bearing element being integrated into the cutting arm adjacent to the pivot end; and the axle being rotatably engaged with the bearing element.

13. The self-locking cigar cutting tool as claimed in claim 11 comprising:

the detent element further comprising a detent spring and a spring-receiving concavity;

the spring-receiving concavity traversing into the second locking ring; and the detent spring being engaged between the spring-receiving concavity and the first retainer plate, wherein the detent spring displaces the detent element into the locking conduit.

14. The self-locking cigar cutting tool as claimed in claim 11 comprising:

a spine being connected in between the first retainer plate and the second retainer plate;

the spine extending between the pivot end and the cutting end; and a mainspring being mounted between the cutting arm and the spine, wherein the mainspring displaces the cutting arm away from the spine.

15. The self-locking cigar cutting tool as claimed in claim 11 comprising:

the first retainer plate further comprising a travel pin;

the cutting arm further comprising a travel slot;

the travel pin extending between the first retainer plate and the second retainer plate;

the travel slot traversing through the cutting arm along a coradial path to the arcuate channel; and the travel pin being freely positioned within the travel slot, wherein the articulation of the cutting arm is arrested by the impingement of the travel pin upon the terminal ends of the travel slot.

16. The self-locking cigar cutting tool as claimed in claim 11 comprising:

the cutting arm comprising a first concave blade;

the fixed blade comprising a second concave blade; and the first concave blade being positioned laterally opposite the second concave blade within the annular cutting aperture.

17. The self-locking cigar cutting tool as claimed in claim 11 comprising:

the second retainer plate comprising a blade receptacle;

the blade receptacle traversing through the second retainer plate adjacent to the annular cutting aperture; and the fixed blade removably engaging into the blade receptacle.

18. The self-locking cigar cutting tool as claimed in claim 1 comprising:

the cutting arm comprising a cap notch; and the cap notch traversing into the cutting arm adjacent to the cutting end, wherein the cap notch is positioned adjacent to the first retainer plate and the second retainer plate when the cutting arm is in a closed configuration.

19. The self-locking cigar cutting tool as claimed in claim 11 comprising:

a first external scale;

a second external scale;

the first external scale being mounted to the first retainer plate opposite the second retainer plate; and the second external scale being mounted to the second retainer plate opposite the first retainer plate.

* * * * *